US009438978B2

(12) United States Patent
Chiang

(10) Patent No.: US 9,438,978 B2
(45) Date of Patent: Sep. 6, 2016

(54) MICROPHONE

(71) Applicant: Mascot Electric Co., Ltd., Tainan (TW)

(72) Inventor: Kun Tien Chiang, Tainan (TW)

(73) Assignee: MASCOT ELECTRIC CO., LTD., Tianan (TW)

( * ) Notice: Subject to any disclaimer, the term of this patent is extended or adjusted under 35 U.S.C. 154(b) by 0 days.

(21) Appl. No.: 14/312,204

(22) Filed: Jun. 23, 2014

(65) Prior Publication Data

US 2015/0373444 A1 Dec. 24, 2015

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/04*** | (2006.01) |
| *H04R 1/08* | (2006.01) |

(52) U.S. Cl.

CPC . *H04R 1/04* (2013.01); *H04R 1/08* (2013.01); *H04R 1/083* (2013.01); *H04R 9/08* (2013.01); *H04R 11/04* (2013.01); *H04R 17/02* (2013.01); *H04R 21/02* (2013.01); *H04R 2201/107* (2013.01)

(58) Field of Classification Search

CPC ..... H04R 1/08; H04R 1/083; H04R 9/08; H04R 11/04; H04R 17/02; H04R 21/02; H04R 1/04; H04R 2201/107

USPC ..... 381/355

See application file for complete search history.

(56) References Cited

U.S. PATENT DOCUMENTS

| | | | | |
|---|---|---|---|---|
| 5,373,555 A * | 12/1994 | Norris | H04M 1/05 | 379/430 |
| 6,091,829 A * | 7/2000 | Blackmer | H04R 1/083 | 381/345 |
| 6,411,709 B1 * | 6/2002 | Lucey | H04R 1/083 | 379/430 |

* cited by examiner

*Primary Examiner* — Duc Nguyen
*Assistant Examiner* — Sean H Nguyen
(74) *Attorney, Agent, or Firm* — John A. Fortkort; Fortkort & Houston PC

(57) ABSTRACT

A microphone includes a base seat, a tube unit connected the base seat, a sound head, and a cable. The base seat includes a surrounding wall that is formed with at least one through hole, and a base wall that cooperates with the surrounding wall to define a receiving space therebetween, and that has a conical surface for reflecting sound waves toward the through hole. The sound head is disposed in the receiving space, and is spaced apart from the base wall of the base seat. The cable is electrically connected to the sound head and extends through the tube unit.

6 Claims, 4 Drawing Sheets

MICROPHONE

BACKGROUND OF THE INVENTION

1. Field of the Invention

This invention relates to a microphone, more particularly to a wearable microphone.

2. Description of the Related Art

Conventional microphones are generally divided into two categories, handheld and wearable. A conventional wearable microphone can be fixed on a user by a clip or be held on the user's head. Despite the usage, a conventional microphone usually includes abase seat made of hard plastic, a tube unit connected to the base seat, a sound receiver disposed in a receiving space in the base seat, and a cable electrically connected to the sound receiver and passing through the base seat and the tube unit.

The receiving space of the base seat generally has an opening that is held close to the user's mouth, and a closed end opposite to the opening. While sound signals are being received by the sound receiver, part of the signals may pass by the sound receiver and be reflected by the closed end of the receiving space back to the sound receiver as noise, which is then picked up by the sound receiver and affects sound quality. Moreover, the tube unit of the conventional microphone generally does not have sufficient flexibility to absorb shock experienced thereby, which may also lower the signal receiving quality.

On the other hand, for the conventional microphone to be worn on the head of the user, in order to place the sound receiver near the user's mouth, the tube unit usually extends forwardly and downwardly. However, if the user is sweating during usage, the sweat might move along the tube unit to the base seat and finally reach the sound receiver disposed in the base seat and cause poorer signal receiving quality and even damage the sound receiver.

SUMMARY OF THE INVENTION

Therefore, the object of the present invention is to provide a microphone that can overcome at least one of the aforesaid drawbacks associated with the prior art.

According to the present invention, a microphone includes a base seat, a tube unit, a sound head and a cable. The base seat includes a surrounding wall that is formed with at least one through hole, and a base wall that cooperates with the surrounding wall to define a receiving space therebetween and that has a conical surface for reflecting sound waves within the receiving space to leave via the through hole. The tube unit is connected to the base seat. The sound head is disposed in the receiving space of the base seat and is spaced apart from the base wall of the base seat. The cable is electrically connected to the sound head and extends through the tube unit.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
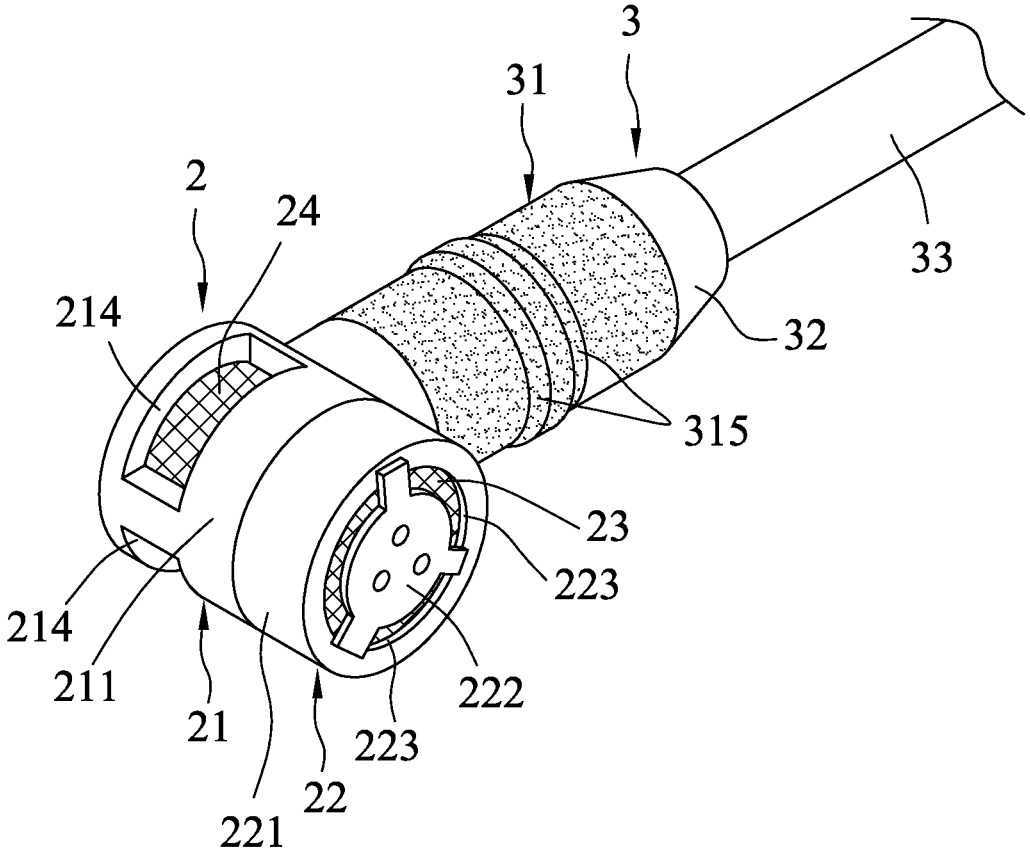
FIG. 1 is a fragmentary perspective view of the preferred embodiment of a microphone according to the present invention.
Figure 2:
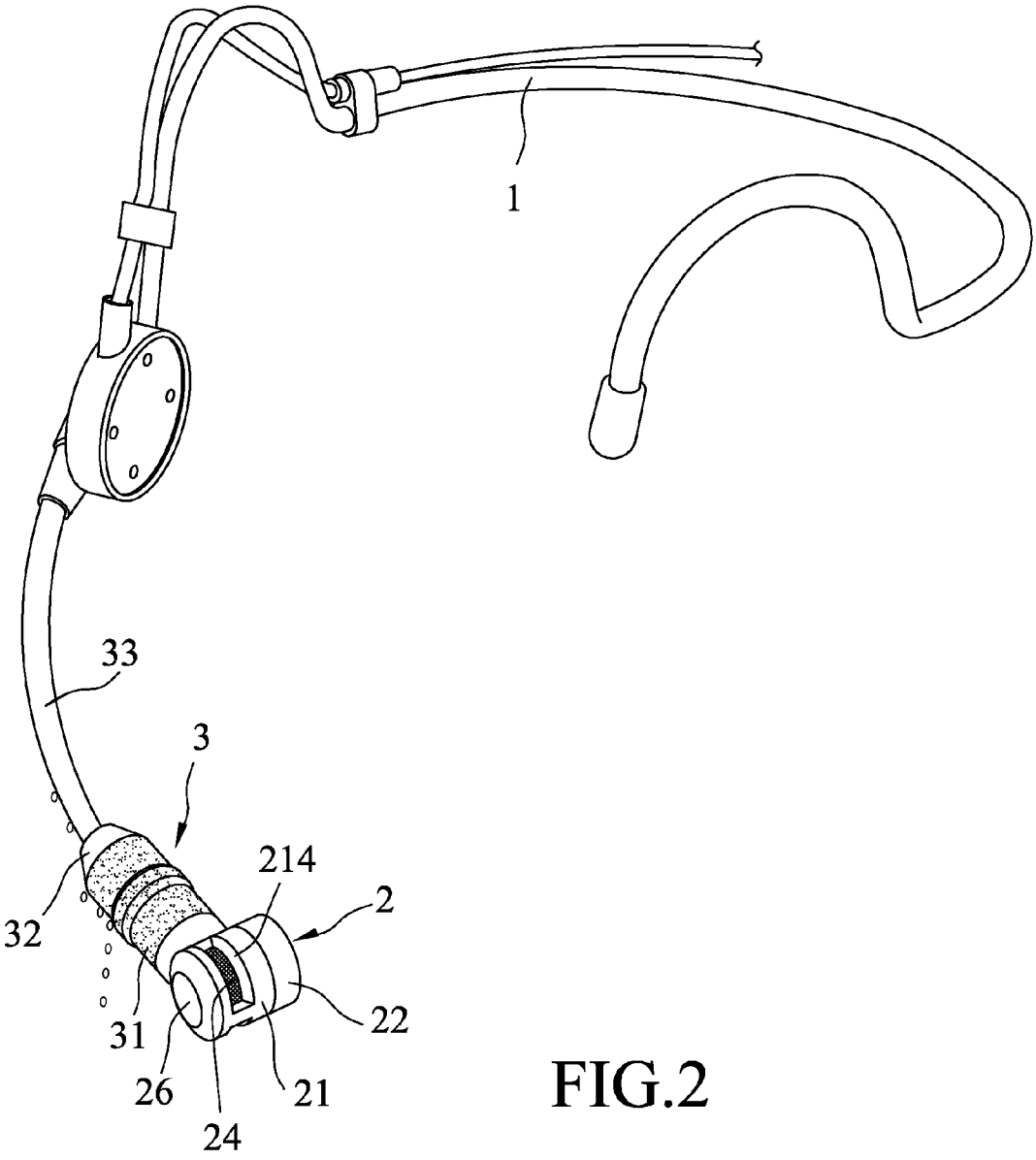
FIG. 2 is a fragmentary perspective view of the preferred embodiment coupled to a hanger.
Figure 3:
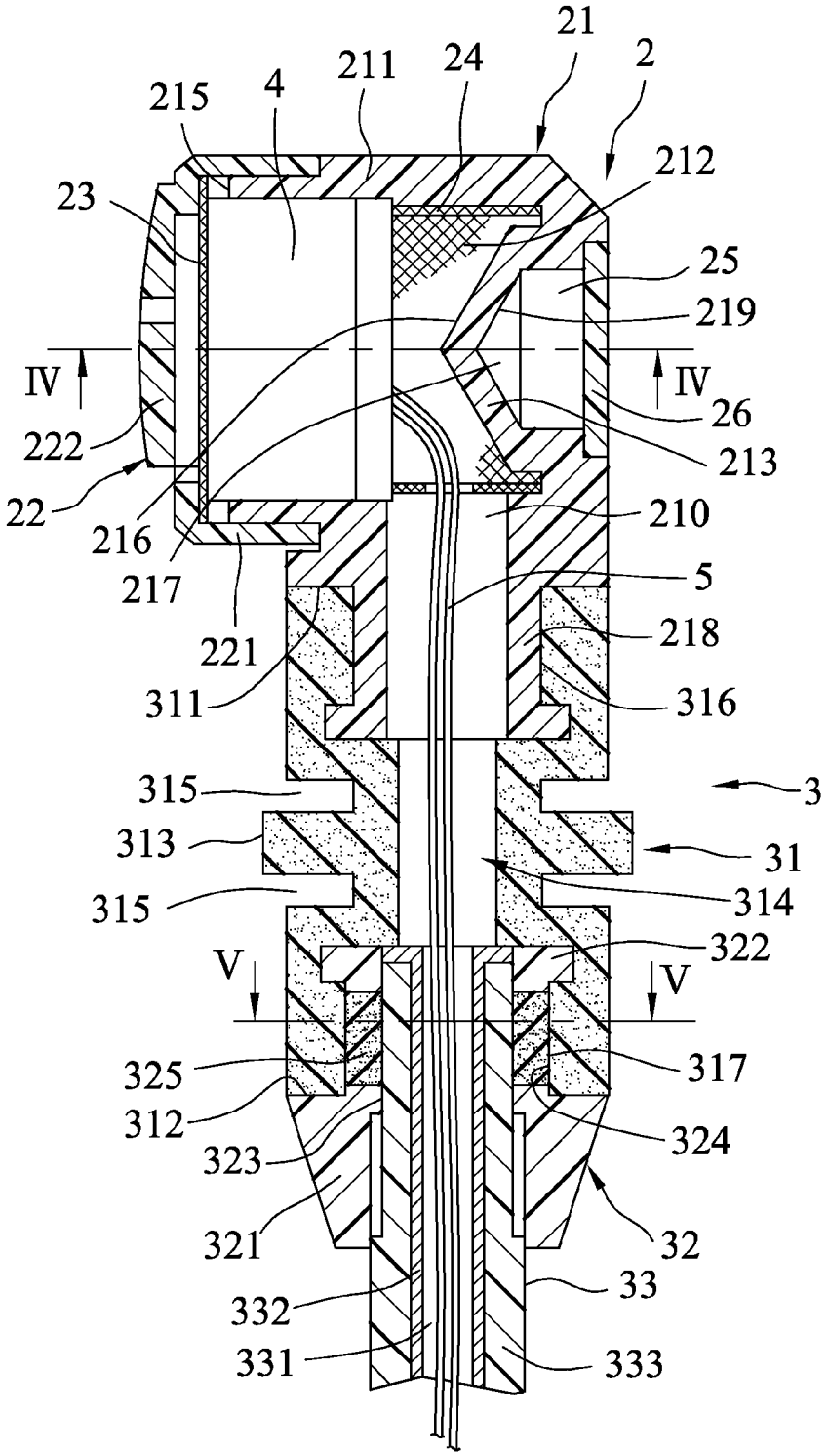
FIG. 3 is a fragmentary partly-sectional view of the preferred embodiment.

Referring to FIGS. 1, 2 and 3, the preferred embodiment of a microphone according to the present invention is fixed to a headband 1 and can be secured on the head of a user. However, the microphone may also be fixed on the clothes of the user using a clip and not be limited to this embodiment. The microphone includes a housing unit 2, a tube unit 3 connected to the housing unit 2, a sound head 4 and a cable 5.

Figure 4:
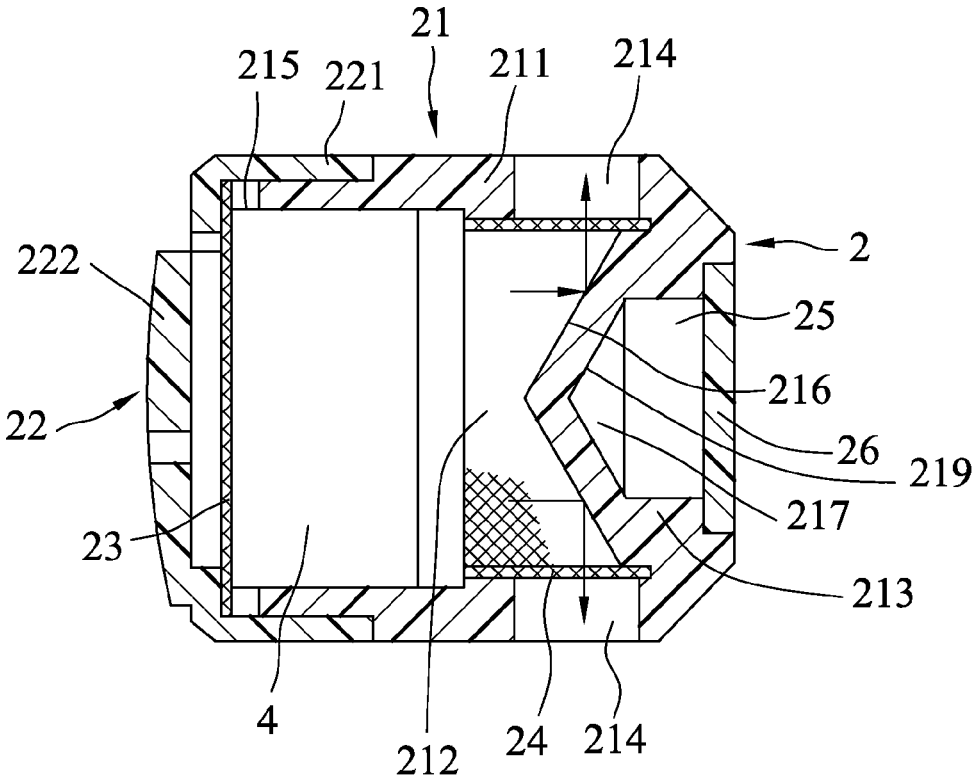
FIG. 4 is a partly-sectional view of the preferred embodiment taken along line IV-IV in FIG. 3.

Referring further to FIG. 4, the housing unit 2 of this embodiment includes a base seat 21, a surrounding screen 24, an end cap 22, an end screen 23, a rear cap 25 and a brand plate 26. In this embodiment, the base seat 21 includes a surrounding wall 211 that is formed with two through holes 214, a base wall 213 that cooperates with the surrounding wall 211 to define a receiving space 212 therebetween, and a linking wall 218 that is connected to the surrounding wall 211 and that is formed with a first cable hole 210 in spatial communication with the receiving space 212. The receiving space 212 has an opening 215 opposite to the base wall 213. The base wall 213 has a conical surface 216 facing the receiving space 212 and tapering toward the opening 215 for reflecting sound waves within the receiving space 212 toward the through holes 214. The base wall 213 further has a groove-defining surface 219 opposite to the conical surface 216 and defining a groove 217. The surrounding screen 24 of the housing unit 2 is disposed in the receiving space 212 and corresponds in position to the through holes 214.

The end cap 22 has a tubular coupling wall 221 coupled to the surrounding wall 211, and an end wall 222 connected to an end of the coupling wall 221 opposite to the base wall 213, and formed with a plurality of angularly spaced-apart cap holes 223 (see FIG. 1). The end screen 23 is disposed between the end wall 222 of the end cap 22 and the surrounding wall 211 of the base seat 21. The rear cap 25 and the brand plate 26 are disposed in the groove 217 of the base seat 21.

Figure 5:
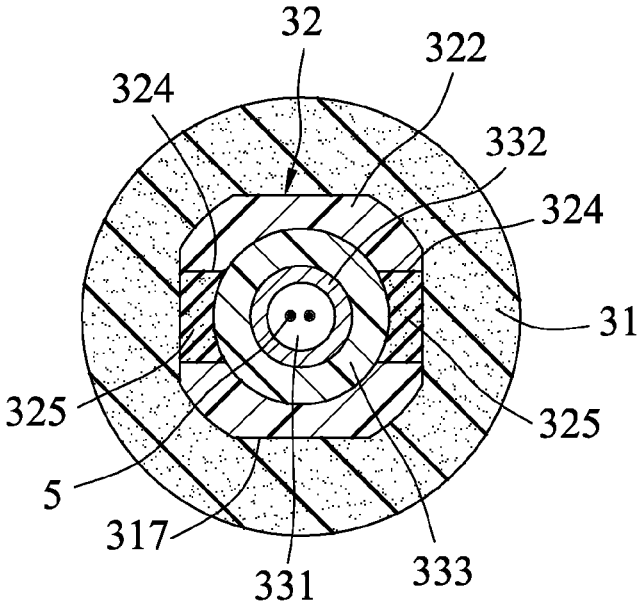
FIG. 5 is another sectional view of the preferred embodiment taken along line V-V in FIG. 3.

Referring further to FIG. 5, the tube unit 3 of this embodiment is connected to the base seat 21 of the housing unit 2, and includes a flexible tube seat 31 connected to the base seat 21, an end tube seat 32 connected to the flexible tube seat 31 opposite the base seat 21, and a cable tube 33 coupled to the end tube seat 32 opposite the flexible tube seat 31. The flexible tube seat 31 is made of a flexible material and is disposed between the end tube seat 32 and the base seat 21. In this embodiment, the flexible tube seat 31 has a first end surface 311 surrounding the linking wall 218 and abutting against the surrounding wall 211 of the base seat 21, a second end surface 312 opposite to the first end surface 311 and abutting against the end tube seat 32, and an outer surrounding surface 313 that is formed with two surrounding grooves 315. The flexible tube seat 31 is formed with a second cable hole 314 that is in spatial communication with the first cable hole 210. The second cable hole 314 has a first engaging hole section 316 engaged with the linking wall 218 of the base seat 21, and a second engaging hole section 317 being polygonal and spaced apart from the first engaging hole section 316.

The end tube seat 32 is made of a hard plastic material and has an abutment portion 321 abutting against the flexible tube seat 31, and an engaging portion 322 having a polygonal cross-section and engaging fittingly the second engaging hole section 317 of the second cable hole 314 (i.e., the engaging portion 322 engages non-rotatably the second engaging hole section 317). The end tube seat 32 further has a coupling passage 323 extending through the abutment portion 321 and the engaging portion 322. The cable tube 33 of the tube unit 3 extends through the coupling passage 323.

In this embodiment, the end tube seat 32 has opposite adhesive-receiving through holes 324 formed in the engaging portion 322 and being in spatial communication with the coupling passage 323, and an adhesive block 325 disposed in the adhesive-receiving holes 324 for bonding the flexible tube seat 31, the end tube seat 32 and the cable tube 33 together. During manufacturing of this embodiment, a viscous adhesive is filled in the adhesive-receiving holes 324 before the flexible tube seat 31, the end tube seat 32 and the cable tube 33 are assembled together. The viscous adhesive would then harden and become the adhesive block 325.

The cable tube 33 of the tube unit 3 is coupled to and extends through the coupling passage 323 of the end tube seat 32, and has an inner tube wall 332 that defines a third cable hole 331 and an outer tube wall 333 that is sleeved on the inner tube wall 332. The third cable hole 331 is in spatial communication with the second cable hole 314.

In this embodiment, the sound head 4 is disposed in the receiving space 212 of the base seat 21, and is spaced apart from the base wall 213 of the base seat 21. The cable 5 is electrically connected to the sound head 4, and extends through the first cable hole 210, the second cable hole 314 and the third cable hole 331.

Due to the presence of the flexible tube seat 31, vibration from the headband 1 which would otherwise reach the sound head 4 through the tube unit 3 is absorbed by the flexible tube seat 31. Furthermore, sound waves in the receiving space 212 would be reflected by the conical surface 216 of the base wall 213 to pass through the through holes 214 (as indicated by the arrows in FIG. 4) instead of being received by the sound head 4, thereby improving sound receiving quality.

Another aspect of this embodiment is that, when the headband 1 is worn on the head of the user, sweat of the user would flow along the cable tube 33 toward the base seat 21, and be blocked by the surrounding grooves 315 to drip off from the microphone, thereby protecting the sound head 4 from being damaged by the sweat.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A microphone comprising:

a base seat including a surrounding wall that is formed with at least one through hole, and a base wall that cooperates with said surrounding wall to define a receiving space therebetween, and that has a conical surface for reflecting sound waves toward said through hole;

a tube unit connected to said base seat;

a sound head disposed in said receiving space of said base seat, and spaced apart from said base wall of said base seat; and a cable electrically connected to said sound head, and extending through said tube unit;

wherein said tube unit includes a flexible tube seat connected to said base seat, and having an outer surrounding surface that is formed with at least one surrounding groove;

wherein said base seat further includes a linking wall connected to said surrounding wall and formed with a first cable hole, said tube unit further including an end tube seat, said flexible tube seat being disposed between said end tube seat and said base seat, said flexible tube seat of said tube unit being formed with a second cable hole, said second cable hole being in spatial communication with said first cable hole and having a first engaging hole section engaged with said linking wall of said base seat, said cable extending through said first and second cable holes; and wherein said tube unit further includes a cable tube coupled to said end tube seat, and having an inner tube wall that defines a third cable hole, and an outer tube wall that is sleeved on said inner tube wall, said third cable hole being in spatial communication with said second cable hole, said second cable hole further having a second engaging hole section that is spaced apart from said first engaging hole section, said end tube seat having an abutment portion that abuts against said flexible tube seat, and an engaging portion that engages non-rotatably said second engaging hole section of said second cable hole.

2. The microphone as claimed in claim 1, wherein said conical surface of said base wall of said base seat tapers toward said sound head.

3. The microphone as claimed in claim 1, wherein said end tube seat further has:

a coupling passage, said cable tube extending through said coupling passage;

at least one adhesive-receiving hole formed in said engaging portion and being in spatial communication with said coupling passage; and an adhesive filled in said at least one adhesive-receiving hole for bonding said flexible tube seat and said cable tube.

4. The microphone as claimed in claim 3, further comprising a surrounding screen that is disposed in said receiving space and that corresponds in position to said at least one through hole, an end cap that is coupled to said surrounding wall and opposite to said base wall, and an end screen that is disposed between said end cap and said surrounding wall.

5. The microphone as claimed in claim 2, wherein said end tube seat further has:

a coupling passage, said cable tube extending through said coupling passage;

at least one adhesive-receiving hole formed in said engaging portion and being in spatial communication with said coupling passage; and an adhesive filled in said at least one adhesive-receiving hole for bonding said flexible tube seat and said cable tube.

6. The microphone as claimed in claim 5, further comprising a surrounding screen that is disposed in said receiving space and that corresponds in position to said at least one through hole, an end cap that is coupled to said surrounding wall and opposite to said base wall, and an end screen that is disposed between said end cap and said surrounding wall.

* * * * *